US011937659B2

(12) United States Patent
Lübke et al.

(10) Patent No.: US 11,937,659 B2
(45) Date of Patent: Mar. 26, 2024

(54) VISOR MECHANISM FOR A SAFETY HELMET

(71) Applicant: SCHUBERTH GMBH, Magdeburg (DE)

(72) Inventors: Karsten Lübke, Altenhausen (DE); Michél Schrader, Eilsleben OT Wormsdorf (DE); Milad Youkhanna, Leinfelden-Echterdingen (DE); Michael Jarisch, Erxleben OT Groppendorf (DE); Sebastian Reitebuch, Berlin (DE)

(73) Assignee: SCHUBERTH GMBH, Magdeburg (DE)

( * ) Notice: Subject to any disclaimer, the term of this patent is extended or adjusted under 35 U.S.C. 154(b) by 0 days.

(21) Appl. No.: 17/641,993

(22) PCT Filed: Sep. 10, 2020

(86) PCT No.: PCT/EP2020/075334
§ 371 (c)(1),
(2) Date: Mar. 10, 2022

(87) PCT Pub. No.: WO2021/048281
PCT Pub. Date: Mar. 18, 2021

(65) Prior Publication Data

US 2022/0369754 A1 Nov. 24, 2022

(30) Foreign Application Priority Data

Sep. 10, 2019 (DE) ..... 10 2019 124 245.2

(51) Int. Cl.
*A42B 3/22* (2006.01)

(52) U.S. Cl.
CPC ..... *A42B 3/222* (2013.01); *A42B 3/225* (2013.01)

(58) Field of Classification Search
CPC ..... A42B 3/222; A42B 3/225
See application file for complete search history.

(56) References Cited

U.S. PATENT DOCUMENTS 3,593,338 A 7/1971 Penny
3,601,813 A * 8/1971 Aileo ..... A42B 3/228 2/6.4

(Continued)

FOREIGN PATENT DOCUMENTS

DE 1947919 A1 10/1970
DE 2041485 A1 3/1971

(Continued)

OTHER PUBLICATIONS

International Search Report dated Nov. 25, 2020 re: Application No. PCT/EP2020/075334, pp. 1-2.

*Primary Examiner* — Khoa D Huynh
*Assistant Examiner* — Erick I Lopez
(74) *Attorney, Agent, or Firm* — CANTOR COLBURN LLP

(57) ABSTRACT

A visor mechanism for a safety helmet, in particular for emergency services, includes a visor, which is slidably mounted relative to an outer shell of the safety helmet in order to cover a front region of the safety helmet, and a visor adjuster, which is coupled to the visor so that the visor can be slid by a sliding actuation of the visor adjuster. The visor mechanism has a locking assembly coupled to the visor and the visor adjuster, which locking assembly, when locked, blocks the sliding of the visor, and which locking assembly (6), when released, allows the visor to slide. The locking assembly can be released by a release actuation of the visor adjuster. A safety helmet may include a visor mechanism of this type.

14 Claims, 7 Drawing Sheets

(56) References Cited

U.S. PATENT DOCUMENTS

| | | | | |
|---|---|---|---|---|
| 2007/0283801 | A1 | 12/2007 | Gallo | |
| 2011/0067158 | A1* | 3/2011 | Lee | A42B 3/226 2/15 |

FOREIGN PATENT DOCUMENTS

| | | | |
|---|---|---|---|
| EP | 1797783 | A1 | 6/2007 |
| EP | 2689680 | A2 | 1/2014 |

* cited by examiner

VISOR MECHANISM FOR A SAFETY HELMET

TECHNICAL FIELD

The disclosure relates to a visor mechanism for a safety helmet with the features of the generic term of Claim 1 and a safety helmet with such a visor mechanism.

BACKGROUND

Safety helmets, in particular, for use by the police or other emergency services, primarily serve to protect the wearer from mechanical injury risks. In addition to the usual outer shell, they also regularly comprise a visor with a transparent shield, which can be folded down if necessary to protect the face, thereby protecting the wearer from blows to the face area or thrown objects in particular.

Due to the technical progress of recent years, laser emitters or laser pointers have come onto the market, which can achieve a high level of beam power despite their small size. Legal regulations limiting the power of available laser pointers have proven to be easily circumvented. Due to their dangerous glare effect, laser pointers with high power, in particular, represent a new source of danger for police and other emergency services, the defence of whom has rarely been taken into account in the standard equipment of police officers. A suitable means of protection against laser beams are shields with special optical properties, which can be placed in front of the eyes as a visor.

From prior art, it is known to offer such visors either integrated into a safety helmet from the outset or as a retrofittable device for safety helmets. It is expedient to place such a laser protection visor—similar to the conventional visor—against mechanical hazards—optionally and therefore only, if necessary, in the field of vision, since, only in certain situations, the danger of laser pointers is a threat, and the required tint of the protective visor could excessively impair view in other situations. It is also appropriate to provide a different visor for laser protection than the main visor for mechanical protection. This is because, while the main visor must cover the entire facial area, laser protection is only required for the eyes. When only laser protection is implemented, the mouth area can remain free, which, in turn, facilitates the communication of the wearer of the safety helmet and reduces the risk of the laser safety screen fogging up.

For the optional movement of the laser protection between an extended protective position and a retracted position, in which the laser protection does not cover the eye area, it is known to provide a shift mechanism. On the one hand, this shift mechanism should make it possible to bring the laser protection reliably and quickly into the desired position and, on the other hand, prevent the laser protection from unintentionally adjusting. Such an unintentional adjustment from the extended to the retracted position would obviously be dangerous, but an unintentional extension can also have negative consequences.

SUMMARY

Starting from this prior art, the disclosure therefore further develops and improves a visor mechanism known from prior art for a safety helmet in such a way that the visor or the laser protection can be quickly and reliably brought into the protective position and does not unintentionally move away from this position.

This task is achieved by the features of the characterizing part of Claim 1 for a visor mechanism with the features of the generic term of Claim 1. With regard to a safety helmet, it is solved by means of a safety helmet with the features of Claim 14.

The knowledge that the structure to be operated for shifting can also be used to bring about a locking of the visor or the laser protection is essential for the disclosure. In this way, the use of only one hand is required to bring the visor or laser protection into the desired position while simultaneously ensuring that the visor or laser protection remains in that position.

The proposed visor mechanism is for a safety helmet, wherein this can be in particular a safety helmet for emergency services. The proposed visor mechanism comprises a visor, which is mounted in such a way that it can be shifted relative to an outer shell of the safety helmet in order cover a front area of the safety helmet, and a visor adjuster, which is coupled to the visor in such a way that the visor can be shifted by a sliding actuation of the visor adjuster. By a front area of the safety helmet, the front open area is understood that corresponds to the facial area and, in particular, to the eye area of a wearer of the safety helmet. The sliding actuation can basically be any type of actuation of the visor adjuster.

The proposed visor mechanism is characterized in that the visor mechanism comprises a locking assembly coupled to the visor and the visor adjuster, which locking assembly, in a locked state, blocks a shifting of the visor and which locking assembly in a released state allows a shifting of the visor. The proposed visor mechanism is further characterized in that the locking assembly can be moved into the released state via a release actuation of the visor adjuster.

The locking assembly can therefore alternately assume a locked state and a released state. In addition to the locked state and the released state, there can also be other states that the locking assembly can assume. In principle, the release actuation can be any type of actuation of the visor adjuster. Blocking the shifting of the visor also leads to a blocking of the shifting of the visor adjuster.

Preferably, the locking assembly provides a chain of force action from the visor adjuster to the visor. This distinguishes itself from a mechanical system in which, for example, by actuating the visor adjuster, a preloaded spring is unlocked, which then shifts the visor.

A preferred embodiment of the visor mechanism is characterized in that the visor mechanism comprises a cover for a fixed arrangement on the outer shell. In particular, it can be that the visor is mounted in such a way that it can be shifted relative to the cover. It can also be that the visor adjuster is mounted in such a way that it can be shifted relative to the cover.

Another preferred embodiment of the visor mechanism is characterized in that the visor is arranged under the cover and the visor adjuster on the cover. The information below and above can be related to the outer shell of the safety helmet. Consequently, this preferred embodiment corresponds to an arrangement of the visor between the cover and the outer shell and an arrangement of the visor adjuster in such a way that the cover is arranged between the visor adjuster and the outer shell. In this way, both a good manual accessibility of the visor adjuster as well as a protection of the visor in the retracted state is achieved.

Preferably, a shifting of the visor and/or the visor adjuster is essentially carried out along a surface of the cover. This means, in particular, that the shifting does not have to take place along a straight path but can also describe a curve. In particular, it can be that a shifting of the visor adjuster, and, alternatively or additionally, a shifting of the visor essentially follows a circular path or another curve.

In accordance with a preferred embodiment of the visor mechanism, it is provided that the locking assembly springs back into the locked state upon ending the release actuation. In other words, the locking assembly is "pre-stressed" to the locked state. In this way, a reliable locking of the visor is always given if the release actuation is not being carried out. Here, it is further preferred that the locking assembly comprises a spring assembly for pre-tensioning the locking assembly to the locked state. In other words, the spring assembly is set up to bring the locking assembly into the locked state in the absence of an opposing effect—for example, via the release actuation.

In accordance with a further preferred embodiment of the visor mechanism, it is provided that the locking assembly comprises a slide guide fixed to the outer shell and a shifting element coupled to the visor adjuster and received by the slide guide. In particular, it is a moveable shifting element. In particular, the shifting element can be coupled to the visor adjuster in such a way that the shift element is carried by the visor adjuster in the event of shifting.

It is further preferred that the shifting element comprises a blocking element, which locking element engages into the cover in the locked state to block the shifting of the visor in a positive-locking manner. In particular, it can be that particularly the blocking element as part of the shifting element is received by the slide guide. The blocking element is preferably an essentially half-cylinder projection.

A preferred embodiment of the visor mechanism is characterized in that the cover comprises a plurality of blocking structures, which are each set up to receive the blocking element. Accordingly, the plurality of blocking structures are essentially half-cylinder-like recesses. Such an embodiment ensures that the blocking element regularly also slides into one of the two blocking structures even in an intermediate position between two blocking structures. Furthermore, it can be that the blocking structures are arranged along a shifting path of the shifting element. It is preferred that the blocking structures are essentially arranged adjacent to one another, one after another. In this way, there are no gaps between the individual blocking structures. It is further preferred that each blocking structure defines a different shifting position of the shifting element. Preferably, the blocking structures are arranged on one side of the cover facing the outer shell.

A further preferred embodiment of the visor mechanism is characterized in that the spring assembly is set up to pre-tension the blocking element in the direction of the blocking structures. It is also preferred that the shifting element is set up to release the blocking element from the blocking structures upon a release actuation of the visor adjuster. It is preferred that the shifting element comprises a cross member which is arranged between the outer shell and the spring assembly, and which is set up to exert a tensile force onto the spring assembly in the direction of the outer shell upon release actuation. This tensile force onto the spring assembly can also be described in its direction as opposing the direction towards the blocking structures.

A preferred embodiment of the visor mechanism is characterized in that the release actuation is a pressure actuation of the visor adjuster essentially perpendicular in the direction of the outer shell. For this type of operation, it is ensured that the user and therefore the wearer of the safety helmet can apply sufficient force to exit the locked state. On the other hand, it is preferred for the sliding actuation that the sliding actuation is an actuation of the visor adjuster essentially along the outer shell. Due to these different actuation directions, the two types of actuation can be controlled and optionally carried out separately or together.

In general, the visor can be a part formed as a single piece. In accordance with a further preferred embodiment of the visor mechanism, it is provided that the visor comprises a shield which is at least partially transparent. In this case, the shield represents that part of the visor that can be moved in front of the eyes of a wearer of the safety helmet. It is preferred that the shield is preferably attached by means of a positive-locking fit to a carrier part of the shifting element.

A preferred embodiment of the visor mechanism is characterized in that the visor has a laser protective lens for eye protection against laser beams. It is preferred that the shield is the laser protection shield.

A further preferred embodiment of the visor mechanism is characterized in that the shield comprises at least one shield mounting device and the carrier part comprises a carrier mounting device corresponding to the shield mounting device, wherein the shield mounting device and the carrier mounting device are set up to establish a positive-locking engagement with one another. In particular, it can be that the shield mounting device and the carrier mounting device are set up to establish a detent connection with one another. It can be that the carrier mounting device comprises a mounting opening and the shield mounting device comprises a projection to snap into the mounting opening. However, it can also be that the shield mounting device comprises a mounting opening and the carrier mounting device comprises a projection to snap into the mounting opening. The variants just described make it possible to establish a connection between the shield and the carrier part particularly easily.

In general, the actuation of the visor adjuster can be carried out to shift the visor in any direction. However, in accordance with a preferred embodiment of the visor mechanism, it is provided that the visor adjuster, in particular, with a fixed arrangement of the cover on the outer shell, is essentially shiftable along a central axis in the longitudinal direction of the safety helmet. It is also preferred that the slide guide is essentially arranged around a vertex of the outer shell. This ensures good manual accessibility of the visor adjuster, even in the event that the wearer of the safety helmet wears gloves.

A preferred embodiment of the visor mechanism is characterized in that the visor is moveable via a direct actuation of the visor. Such a direct actuation of the visor is therefore a manual engagement of the wearer of the safety helmet with the visor. Preferably, the visor is moveable via a direct actuation of the visor when the locking assembly is in the released state. Preferably, the locking assembly blocks the shifting of the visor by direct actuation of the visor when the locking assembly is in the locked state.

In accordance with a further preferred embodiment of the visor mechanism, it is provided that the cover comprises a plurality of openings for attaching the cover to the outer shell. These openings can be used in particular to receive fastening means. It is preferred that a pair of the openings are arranged opposite in relation to a vertical median plane of the cover on a common axis. In particular, it can be that the opposite openings form rotary holes, which are set up for the pivoting attachment of an outer visor. This outer visor can be a conventional visor of the safety helmet, which is intended to provide mechanical protection. By attaching the outer visor to the cover, it is also ensured that the visor is arranged on the inside to the outside visor so that it can also be protected by the outer visor.

A preferred embodiment of the visor mechanism is characterized in that the cover has at least one locking hole for locking the outer visor. This makes it easier to keep the outer visor in the desired position. It is preferred that the cover has at least two substantially opposite locking holes. It is also preferred that the locking holes are each arranged adjacent to a rotary hole. The cover can also have more than two locking holes. Through these locking holes, the outer visor can be held in a desired position. Further details on how it works are described below in connection with the outer visor. In particular, it can be that each a rotary hole with the adjacent locking hole or the adjacent locking holes is arranged on an essentially flat section of the cover. This makes it easier to arrange the locking holes in the area smeared by the outer visor by pivoting. It is further preferred that a respective pin element of the visor mechanism in the at least one locking hole is arranged in such a way that the respective pin element protrudes at least partially from the at least one locking hole. Such a pin element can also be used to lock the outer visor.

It is preferred that the visor mechanism is provided separately and can therefore be mounted on a safety helmet. In particular, it can be that the visor mechanism can be retrofitted to a safety helmet, which was not intended for such assembly from the outset. However, it can also be that the visor mechanism is an integral and original component of a safety helmet.

The proposed safety helmet, which can in particular be a safety helmet for emergency services, is characterized in that the safety helmet comprises an outer shell for the distribution of impact forces and a proposed visor mechanism attached to the outer shell. It is preferred that the safety helmet comprises fastening means for attaching the cover to the outer shell.

A preferred embodiment of the proposed safety helmet is characterized in that the safety helmet comprises an outer visor for mechanical face protection, which outer visor is pivotably attached to the outer shell. Furthermore, it is preferred that the outer visor is attached to the outer shell by means of the rotary holes. This fastening can be carried out in particular by means of a passage of the outer visor or a fastening element through the rotary holes. In particular, it is preferred that the outer visor is arranged in such a way that the outer visor can cover the visor. It is further preferred that the outer shell with the rotary holes comprises aligning drill holes for attaching the visor mechanism and/or the outer visor to the outer shell.

In accordance with a preferred embodiment of the proposed safety helmet, it is provided that the outer visor comprises a seal element for sealing between the outer visor and the visor. It is preferred that the outer visor comprises an outer visor shield, at the upper edge of which the seal element is arranged. In particular, it can be that the seal element extends across a significant part of the upper edge of the outer visor shield. Such a seal element prevents precipitation or other liquids from passing the outer visor to the visor.

In accordance with a further preferred embodiment of the proposed safety helmet, it is provided that the outer visor has at least one visor detent plate with at least one detent recess in each case. Each detent recess can correspond to a latching position of the outer visor on the outer shell. In particular, the at least one detent recess can be set up to receive the corresponding pin element in a latching position of the outer visor. The detent recesses can also be continuous locking holes. It is further preferred that the at least one visor detent plate is attached to an upper edge of the outer visor shield on the outer visor shield. However, it is also conceivable that the outer visor comprises at least one visor detent plate with at least one detent projection for the respective engagement into the at least one locking hole.

A further preferred embodiment of the proposed safety helmet is characterized in that the visor is moveable independently of a pivot state of the outer visor. In other words, the visor can be moved in a released state of the locking assembly regardless of how the outer visor is pivoted. Conversely, the locking assembly in the locked state blocks the shifting of the visor regardless of the pivot state of the outer visor.

Preferred embodiments, features and properties of the proposed safety helmet correspond to preferred embodiments, features and properties of the proposed visor mechanism and vice versa.

BRIEF DESCRIPTION OF THE DRAWINGS

Further advantageous and preferred embodiments result from the following description with reference to the figures. In the drawing, which only renders an exemplary embodiment, the figures show.

DETAILED DESCRIPTION OF THE DRAWINGS

Figure 1:
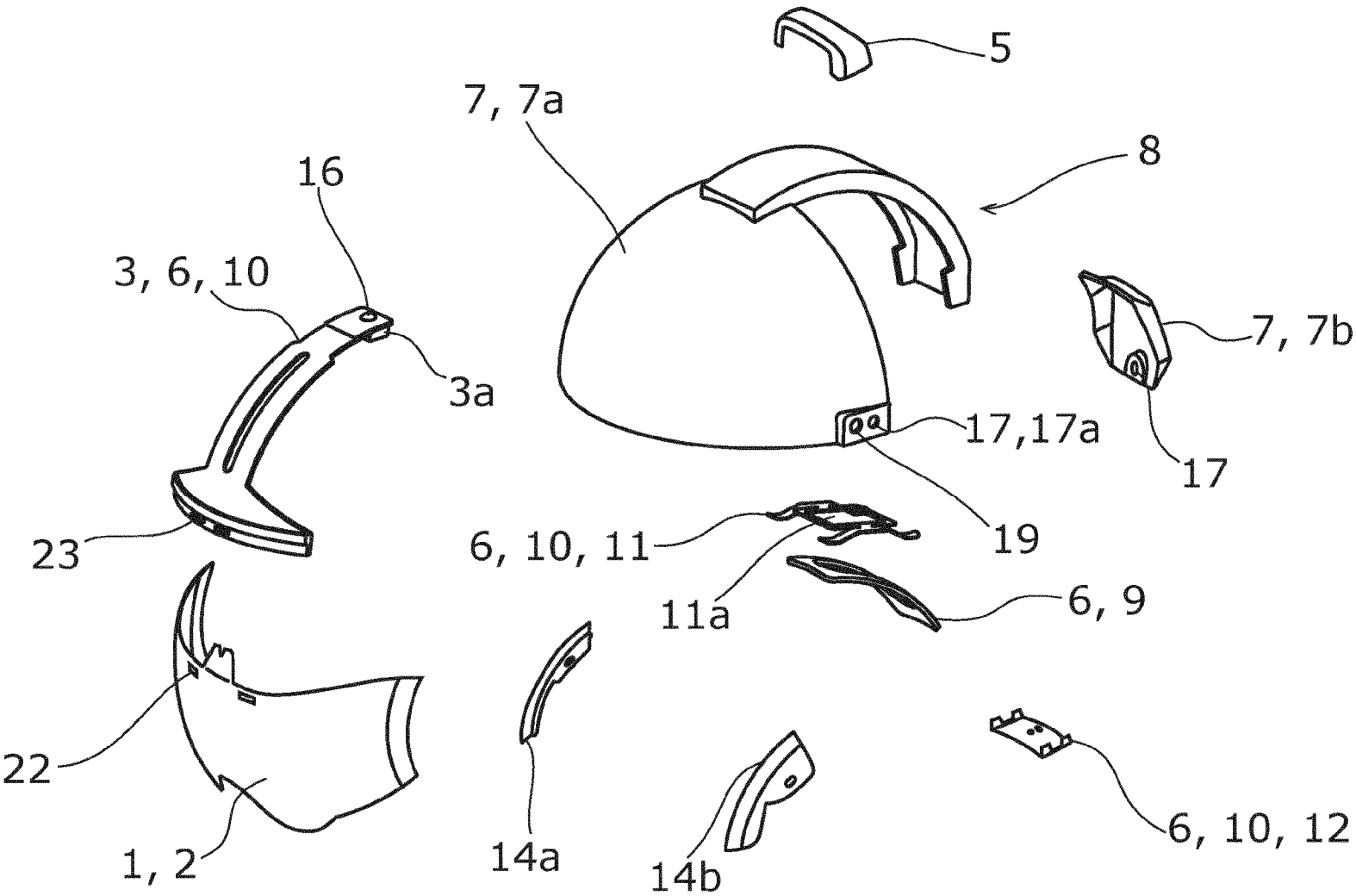
FIG. 1 a perspective exploded view of an exemplary embodiment of a proposed visor mechanism, FIG. 2 a first detailed view of the proposed visor mechanism of FIG. 1, FIG. 3 a second detailed view of the proposed visor mechanism of FIG. 1, FIG. 4*a, b* a lower view of the proposed visor mechanism of FIG. 1 with different position of the visor and the visor adjuster respectively, FIG. 5*a, b* a lateral view and a top view of a proposed safety helmet with the proposed visor mechanism of FIG. 1 with the position of the visor and the visor adjuster as in FIG. 4*a,*

The proposed visor mechanism shown in FIG. 1 is intended for attachment to a safety helmet for emergency services. It can also be subsequently attached to such a safety helmet. The visor mechanism includes a visor 1, which here consists of a shield 2. The shield 2 is semi-transparent and comprises laser safety properties as a laser safety protection shield.

Figure 5B:
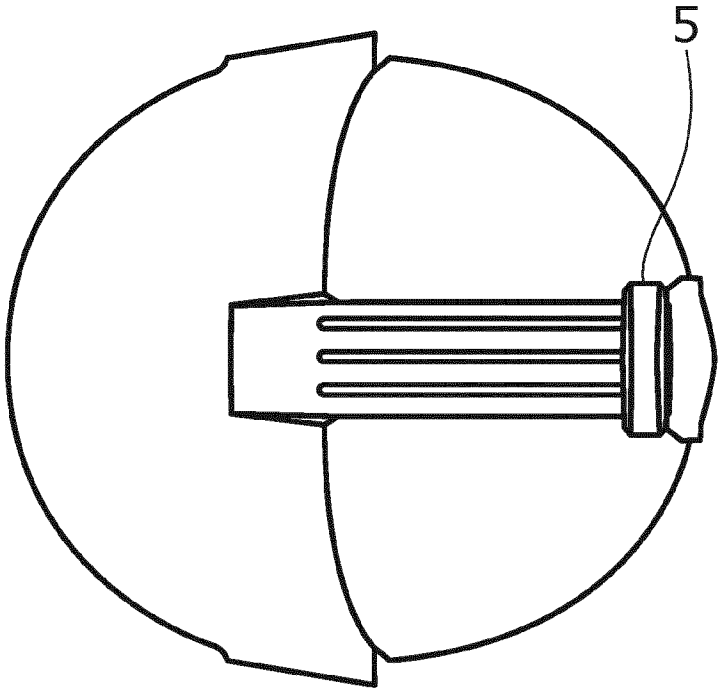
Figure 5A:
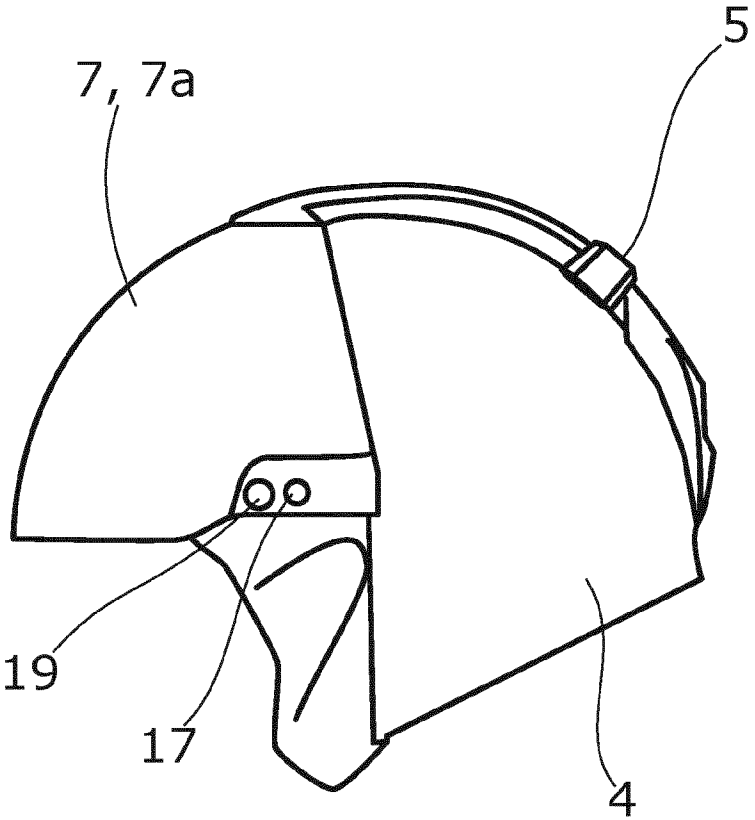
Figure 6B:
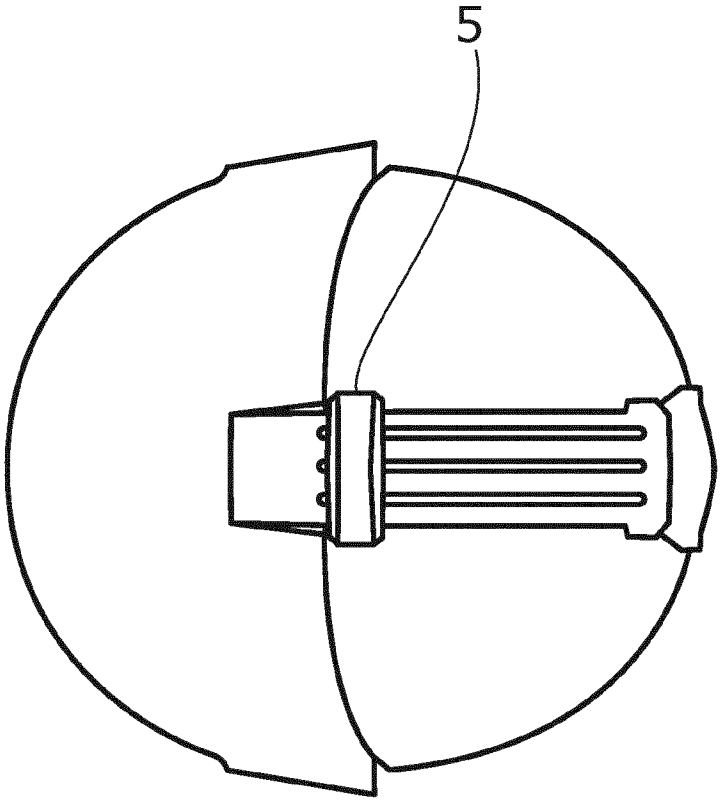
FIG. 6*a, b* a lateral view and a top view of a proposed safety helmet with the proposed visor mechanism of FIG. 1 with the position of the visor and the visor adjuster as in FIG. 4*b* and FIG. 7*a, b* each a lateral view of the proposed shelter of FIG. 4 with an outer visor in different positions.
Figure 6A:
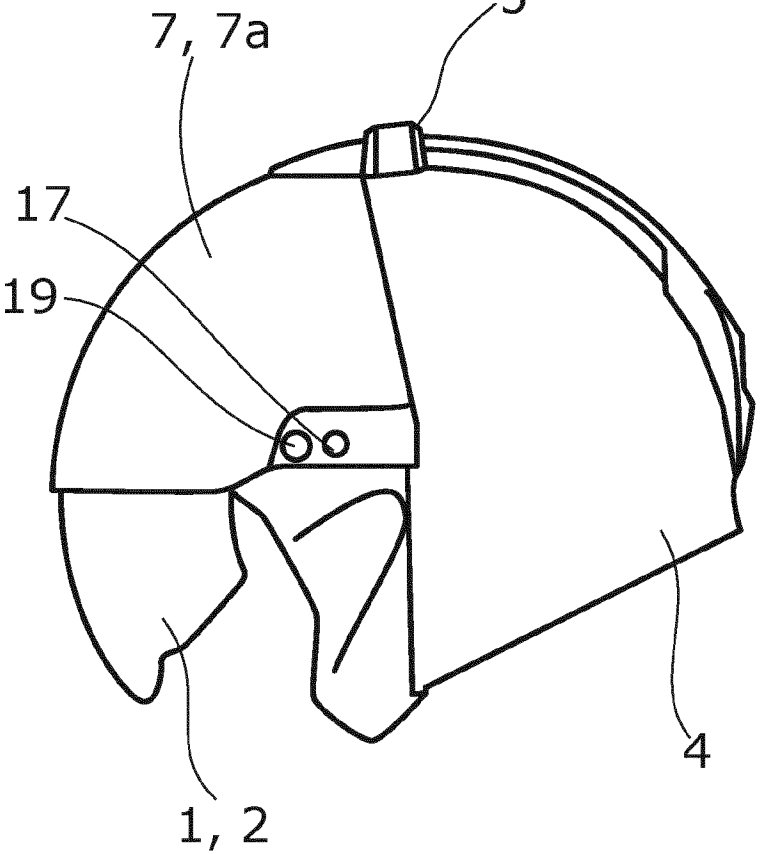

The visor mechanism is attached to an outer shell 4 of the safety helmet in accordance with the illustration of FIGS. 5*a, b* and 6*a, b*. The visor 1 can be shifted compared to this outer shell 4, wherein the different positions of the visor 1 emerge from FIGS. 5*a, b* and 6*a, b* by this shifting. In the position in accordance with FIG. 6*a, b*—the extended position—the visor 1, and particularly the shield 2, covers a front area of the safety helmet.

The visor mechanism also comprises a visor adjuster 5 coupled to the visor 1 via a locking assembly 6 and a cover 7, which is arranged on the outer shell 4 fixed, so that a shifting of the visor 1 with relation to the outer shell 4 is synonymous with a shifting of the visor 1 with relation to the cover 7. Therefore, the visor 1 in the retracted position in accordance with FIG. 5*a, b* is covered by the cover 7 and is therefore not visible in FIG. 5*a, b*. In the present exemplary embodiment, the cover 7 has a front cover part 7*a* and a rear cover part 7*b*.

The visor adjuster 5 can be moved along an outer surface 8 of the cover 7, which leads to a shifting of the visor 1 along an inner surface of the cover 7.

Figures 4A, 4B:
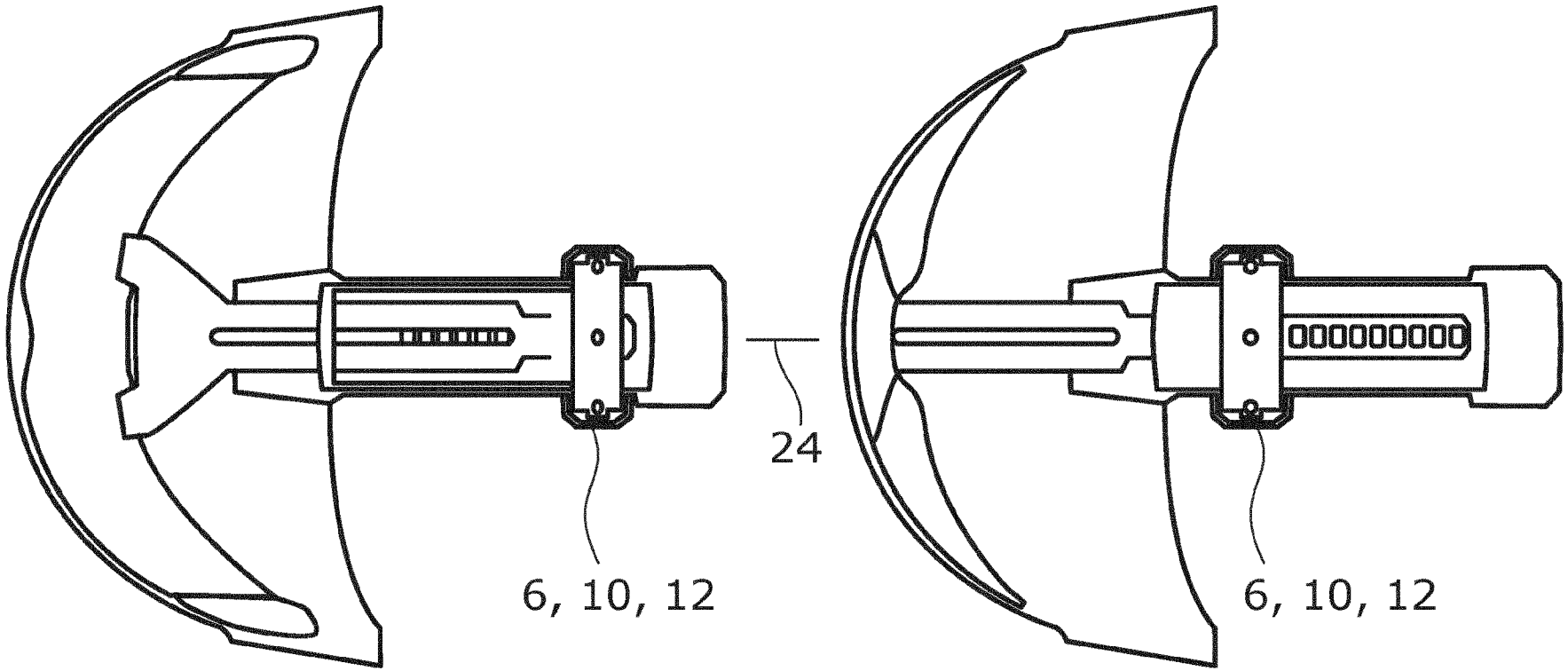

This shifting of the visor adjuster 5 takes place essentially along a central axis 24 shown in FIG. 4*a, b*, which extends in a longitudinal direction of the safety helmet. Since the outer shell 4 is curved, the visor adjuster 5 also essentially follows a circular path, which can be recognized in particular from FIGS. 5*a* and 6*a*.

Figure 2:
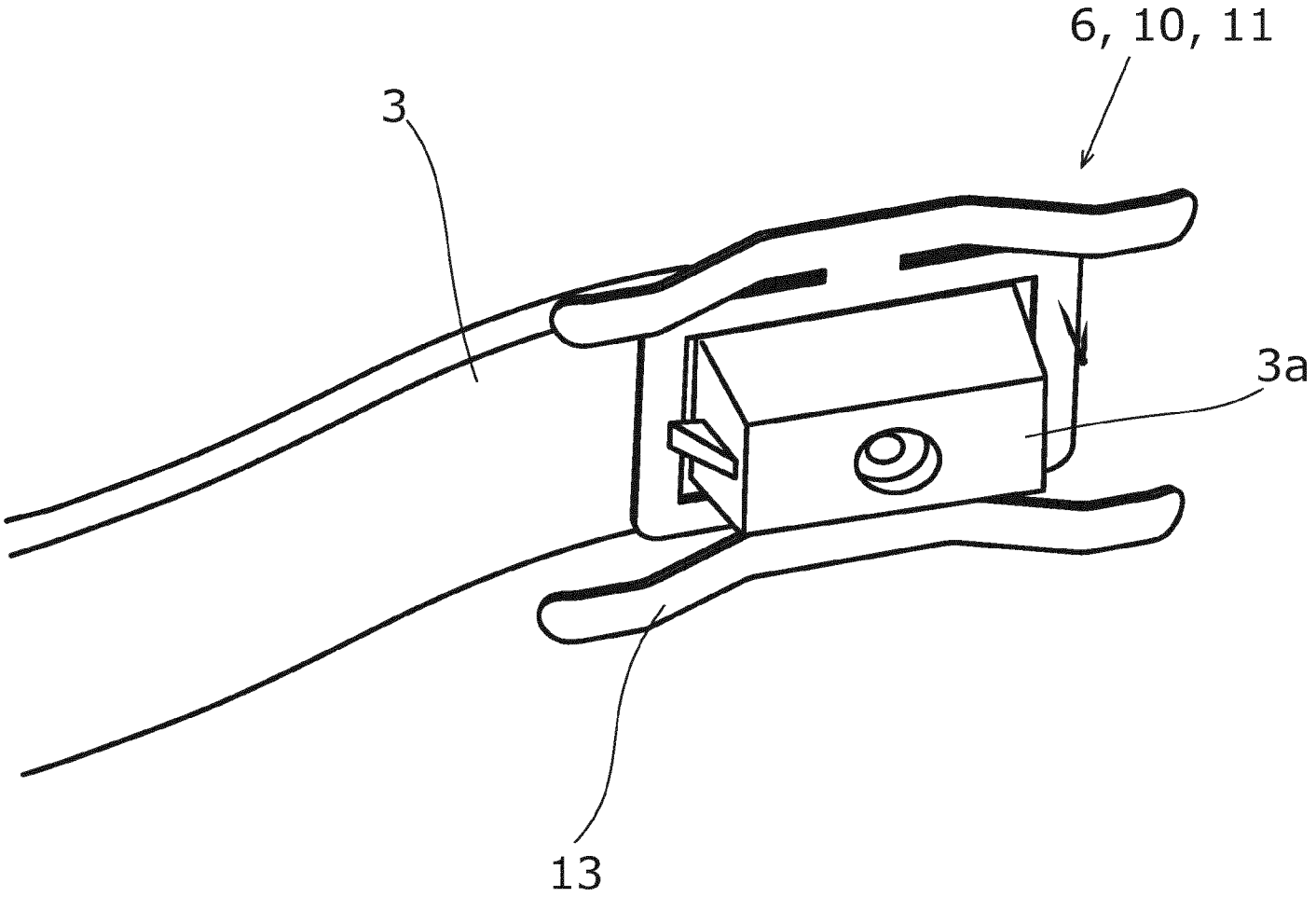

The locking assembly 6 consists of a slide guide 9 and a shifting element 10 received by the slide guide 9, which, in turn, consists of a carrier part 3, to which the visor 1 is attached, a locking plate 11 and a cross member 12. The locking plate 11, in turn, comprises a spring assembly 13. The locking plate 11 is positively coupled to the carrier part 3. Particularly, a projection 3*a* of the carrier part 3 is guided through an opening 11*a* formed by the locking plate 11. This connection is shown in FIG. 2.

The visor adjuster 5 is coupled to the cross member 12 of the shifting element 10 and thus to the locking assembly 6 overall.

The cover 7 has on its side facing the outer shell 4 blocking structures 15, which are formed here as essentially half-cylinder recesses, which extend along the shifting path of the shifting element 10.

Figure 3:
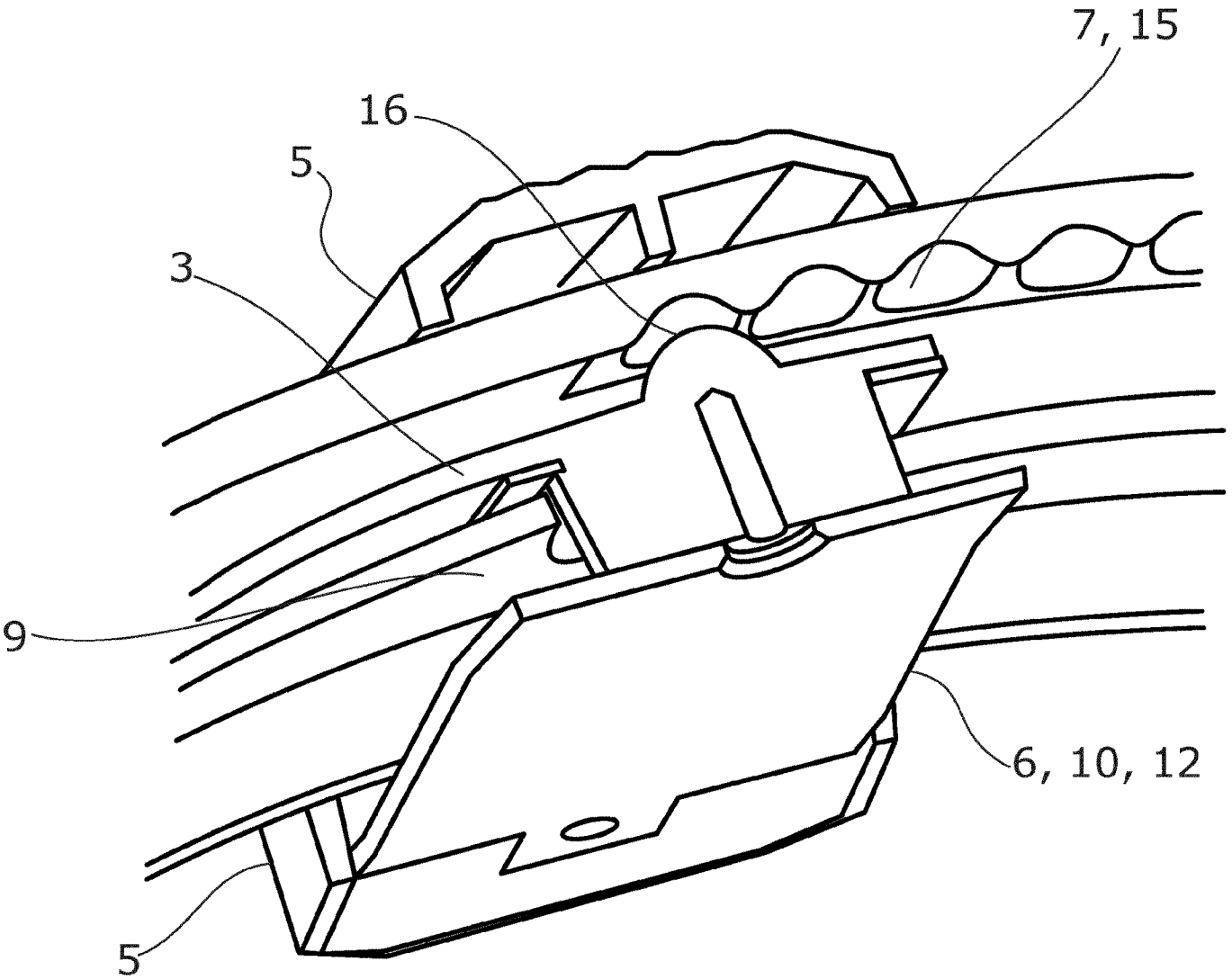

The engagement of the spring assembly 13 with the slide guide 9, which can be seen in FIG. 3, causes the carrier part 3 to be pushed away from the slide guide 9 in the direction of the cover 7. Consequently, the blocking element 16 is also pressed in the direction of the cover 7. Therefore, the locking assembly 6 assumes a locked state without further external influence, in which the blocking element 16 engages into the blocking structure 15 of the cover 7 in a positively locking manner, which corresponds to the current position of the visor adjuster 5 and thus the cross member 12. The lock caused by this engagement fixes the visor 1 in the current position.

The locking assembly 6 only assumes the released state via a release actuation by the wearer of the safety helmet, in which the wearer of the safety helmet pushes the visor adjuster 5 in the direction of the outer shell 4. Due to the pressure on the visor adjuster 5—contrary to the preload of the spring assembly 13—the carrier part 3 is also moved in the direction of the outer shell 4.

In this way, the blocking element 16 is out of action with the blocking structures 15 of the cover 7. Thereby, the locking assembly 6 has assumed the released state. By actuating the visor adjuster 5 in one direction along the outer shell 4—which actuation is referred to here in contrast to the release actuation as a sliding actuation—the visor 1 can now be optionally retracted or extended, but only as long as the release actuation is maintained. Upon ending the release actuation, the blocking element 16 is re-engaged with a blocking structure 15 via the preload of the spring assembly 13 so that a further shifting of the visor 1 is prevented.

The visor mechanism also has slides 14*a, b*, which are connected to the cover 7 and which serve to guide the visor 1. The carrier part 3 has as projections formed carrier mounting devices 23, which snap into corresponding shield mounting devices 22 of the shield 2, which are designed as mounting openings.

Figure 7B:
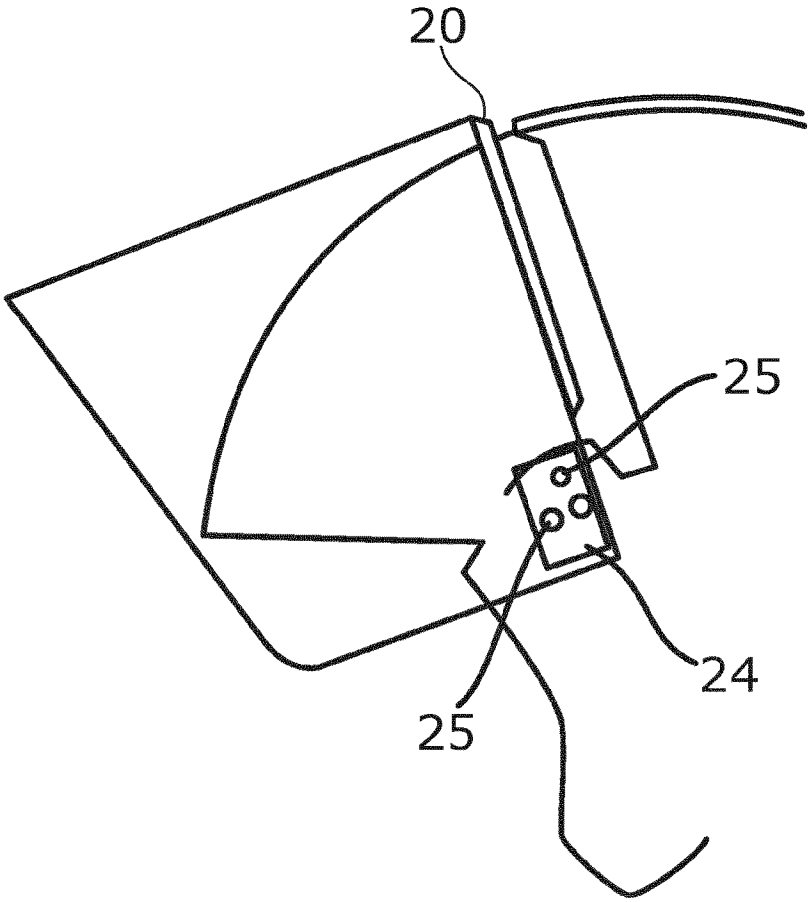
Figure 7A:
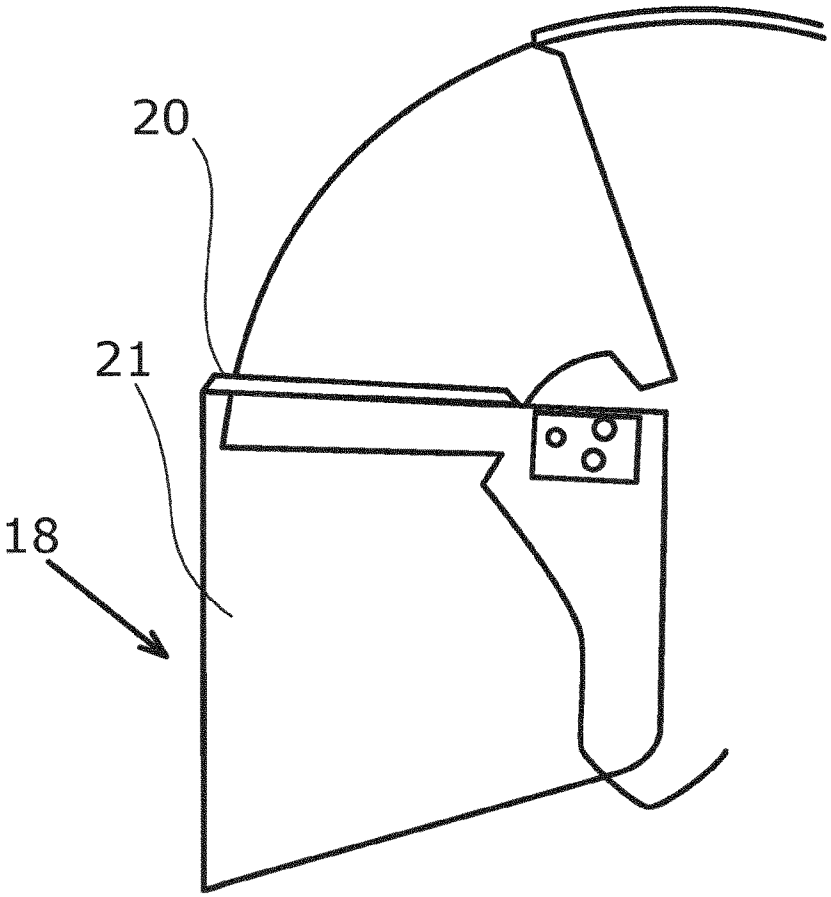

The cover 7 of the exemplary embodiment shown in the drawing comprises a total of three openings 17, through which the cover 7 can be attached to the outer shell 4. Specifically, these openings 17 with corresponding drill holes of the outer shell 4 (not visible here) so that corresponding fastening means can be guided both through the openings 17 as well as through the drill holes of the outer shell 4. A pair of openings 17 is arranged on a common axis opposite in the temple area of the safety helmet while the third opening 17 is placed in a middle rear area of cover 7—particularly in the rear cover part 7*b*. This arrangement of the pair of openings 17 also allows, as shown in FIG. 7*a, b*, an outer visor 18 to be pivotably attached to the outer shell 4 and the cover 7. Accordingly, the opposite openings form 17 rotary holes 17*a* or can be described as a pair of the rotary holes 17*a*. The outer visor 18 has an outer visor shield 21 and at the upper edge of the outer visor writing 21 a seal element 20.

As can be seen in FIG. 1, a locking hole 19 of the cover 7 is arranged adjacent to a rotary hole 17*a*. These locking holes 19 serve to snap the outer visor 18, in particular, in the open position in accordance with the illustration of FIG. 7*b*. Particularly for this purpose, pin elements (not shown in the drawing) are provided, which are arranged in the locking holes 19 and partially protrude from the locking holes 19. Accordingly, the outer visor comprises 18 visor detent plates 24 with two detent recesses 25 each, wherein the detent recesses 25 in each case in different locking positions receive the pin elements for locking the outer visor 18. FIG. 7*a* shows the closed position of the outer visor 18. In this closed position, the visor 1 and in particular the shield 2 are covered by the outer visor 18 and thus protected.

The invention claimed is:

1. A visor mechanism for a safety helmet for emergency services, the visor mechanism comprising: a visor, mounted such that the visor is configured to be shifted relative to an outer shell of the safety helmet to cover a front area of the safety helmet, the visor mechanism further comprising a visor adjuster, which is coupled to the visor such that the visor is configured to be moved via a sliding actuation of the visor adjuster, wherein the visor mechanism comprises a locking assembly coupled to the visor and the visor adjuster, wherein the locking assembly, when in a locked state, blocks a shifting of the visor and wherein the locking assembly, when in a released state, allows a shifting of the visor, and wherein the locking assembly is configured to be moved into the released state via a release actuation of the visor adjuster, wherein the locking assembly springs back into the locked state upon ending the release actuation, wherein the locking assembly comprises a spring assembly for pre-tensioning the locking assembly to the locked state, wherein the spring assembly includes at least two spring arms configured for pre-tensioning the locking assembly to the locked state.

2. The visor mechanism according to claim 1, wherein the visor mechanism comprises a cover for fixed arrangement on the outer shell, wherein the visor is mounted such that the visor is configured to be shifted relative to the cover, such that the visor adjuster is mounted such that the visor adjuster is configured to be shifted relative to the cover.

3. The visor mechanism according to claim 2, wherein the visor is arranged under the cover and the visor adjuster is arranged on the cover, such that a shifting of the visor and/or the visor adjuster is along a surface of the cover, wherein the shifting of the visor adjuster and/or the visor follows a curved path.

4. The visor mechanism according to claim 2, wherein the visor adjuster, when the cover is fixedly arranged on the outer shell, is configured to be shifted along a central axis in the longitudinal direction of the safety helmet, wherein the slide guide is arranged around a vertex of the outer shell.

5. The visor mechanism according to claim 1, wherein the locking assembly comprises a slide guide configured to be fixed to the outer shell and a shifting element coupled to the visor adjuster and received by the slide guide, wherein the shifting element comprises a blocking element, wherein the blocking element, when in a locked state, engages into the cover in a positively locking manner to block the shifting of the visor.

6. The visor mechanism according to claim 5, wherein the cover comprises a plurality of blocking structures, each blocking structure of the plurality of blocking structures being set up to receive the blocking element, wherein the plurality of blocking structures are arranged along a shifting path of the shifting element, wherein each blocking structure defines a different shifting position of the shifting element.

7. The visor mechanism according to claim 6, wherein the spring assembly is set up to pre-tension the blocking element in the direction of the plurality of blocking structures, wherein the shifting element is set up to release the blocking element from the plurality of blocking structures upon a release actuation of the visor adjuster.

8. The visor mechanism according to claim 1, wherein the visor comprises a shield which is at least partially transparent, that the shield is attached to a carrier part of the shifting element by a positive-locking fit.

9. The visor mechanism according to claim 8, wherein the shield comprises at least one shield mounting device and the carrier part comprises at least one carrier mounting device corresponding to the shield mounting device, wherein the shield mounting device and the carrier mounting device are set up to establish a positive-locking engagement with one another.

10. The visor mechanism according to claim 9, wherein the shield is a laser protection shield for eye protection against laser beams.

11. The visor mechanism according to claim 1, wherein the cover comprises a plurality of openings for attaching the cover to the outer shell, wherein a pair of the openings are arranged on a common axis and based on a vertical media plane of the cover are arranged opposite, wherein the opposite openings form rotary holes, configured for the pivoting attachment of an outer visor.

12. The visor mechanism according to claim 11, wherein the cover comprises at least two opposite locking holes, for latching the outer visor, wherein the locking holes are each arranged adjacent to a rotary hole, wherein the rotary hole with the adjacent locking hole is respectively arranged on an flat section of the cover.

13. A safety helmet for emergency services, comprises: an outer shell for the distribution of impact forces and a visor mechanism attached to the outer shell according to claim 1, wherein the safety helmet comprises a fastening component configured to attach the cover to the outer shell.

14. The safety helmet according to claim 13, further comprising an outer visor for mechanical face protection pivotably attached to the outer shell, wherein the outer visor is attached to the outer shell by the openings, wherein the outer visor is arranged so that the outer visor is configured to cover the visor.

* * * * *